United States Patent [19]

Levy

[11] 4,092,543

[45] May 30, 1978

[54] ELECTROSTATIC NEUTRALIZER WITH BALANCED ION EMISSION

[75] Inventor: Warren W. Levy, Cynwyd, Pa.

[73] Assignee: The Simco Company, Inc., Lansdale, Pa.

[21] Appl. No.: 722,392

[22] Filed: Sep. 13, 1976

[51] Int. Cl.[2] ..... H01J 27/00

[52] U.S. Cl. ..... 250/423 R; 361/213

[58] Field of Search ..... 250/423, 324, 325, 251; 361/213, 220

[56] References Cited

U.S. PATENT DOCUMENTS

| | | | |
|---|---|---|---|
| 2,303,321 | 12/1942 | Bennett | 361/213 |
| 2,333,213 | 11/1943 | Slayter | 361/213 |
| 3,743,540 | 7/1973 | Hudson | 361/213 |

*Primary Examiner*—Alfred E. Smith
*Assistant Examiner*—B. C. Anderson
*Attorney, Agent, or Firm*—Stanley Bilker

[57] ABSTRACT

A balanced ion emission system for "shockless type" static eliminators (wherein pointed discharge electrodes are capacitively coupled to one side of an A.C. high voltage source) employs pointed needles which are adjacently spaced from at least some of the pointed discharge electrodes and connected by way of a conductive path to the other side of the A.C. high voltage source. The points of the needles are adapted to be adjustably positioned with respect to the discharge electrodes so that an equal number of ions of each polarity are discharged into the atmosphere for impingement upon the articles to be neutralized.

10 Claims, 5 Drawing Figures

FIG. 2
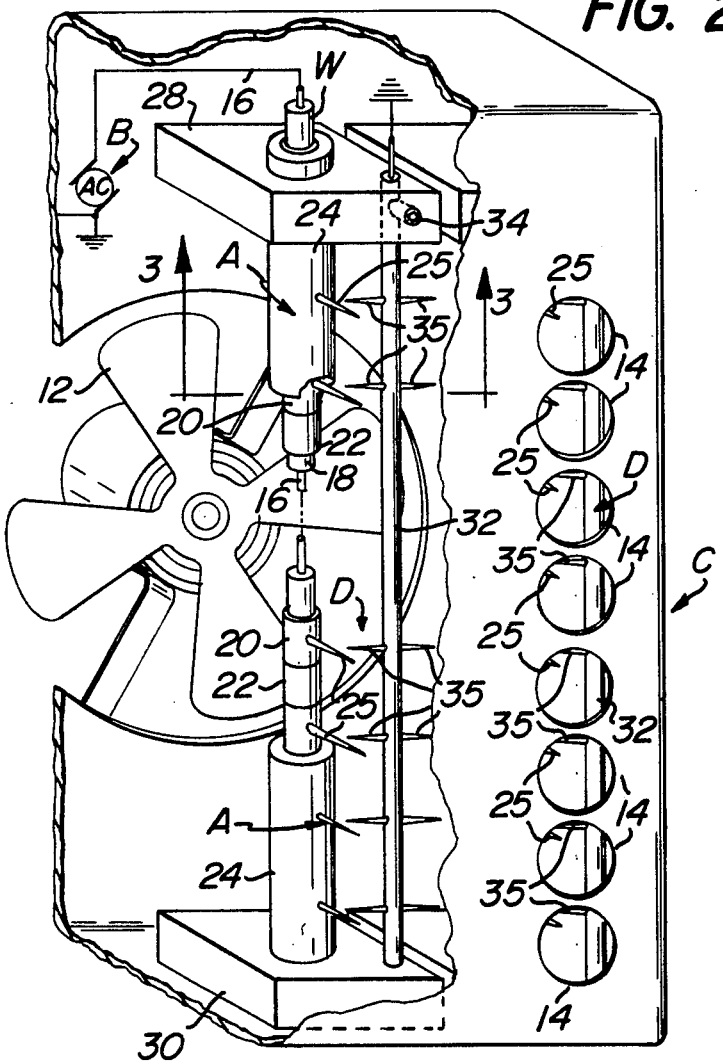
FIG. 1
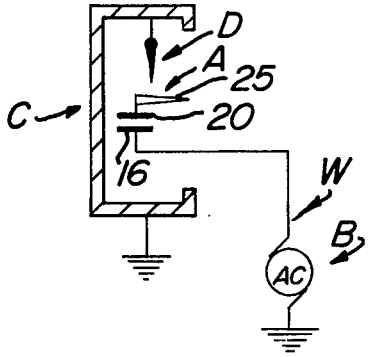
FIG. 4
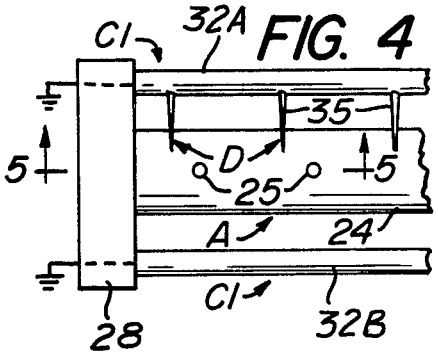
FIG. 3
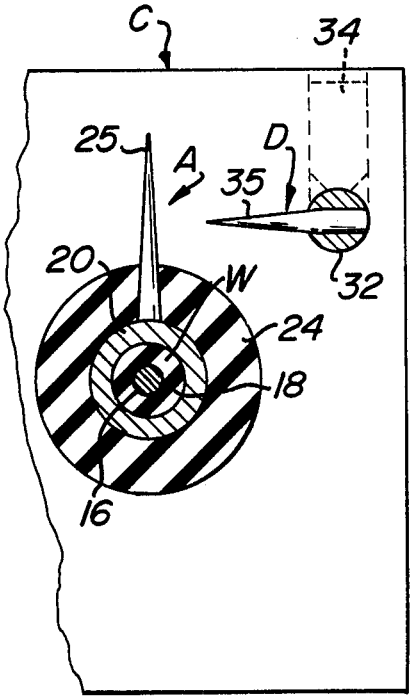
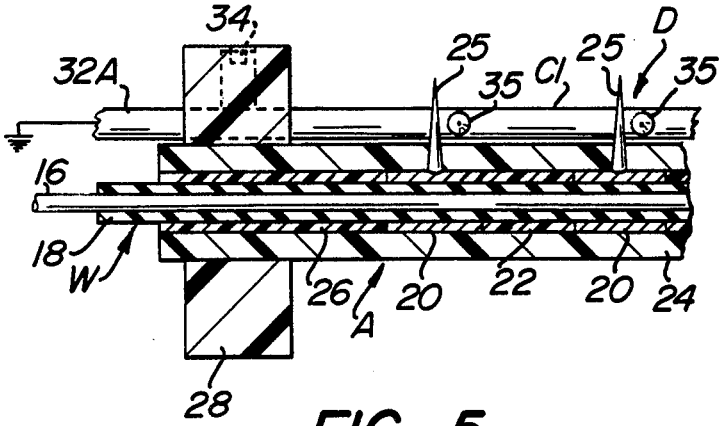
FIG. 5

ELECTROSTATIC NEUTRALIZER WITH BALANCED ION EMISSION

This invention relates to static eliminators or neutralizers, and more particularly relates to corona discharge devices in which an A.C. high voltage has one side connected to a first discharge electrode, usually of pointed disposition, and the other side connected to a conductive member or apertured casing adjacently spaced with respect to the discharge electrode so that both positive and negative ions are emitted, such dual polarity ions being effective to neutralize the surface of articles electrostatically charged by frictional, mechanical, electrical, or other created forces. This invention is especially concerned with static eliminators of the "shockless" variety wherein the discharge electrodes or points are capacitively coupled, either individually or in groups, to the high voltage A.C. source in order to limit the short circuit current which can be drawn from a point so as to minimize the extent of electrical shock or arcing.

As is well known, static eliminators are devices for producing both positive and negative ions in order to neutralize articles which have been charged to a particular polarity, usually as a result of electrostatic or frictional forces. When an A.C. high voltage of fairly high magnitude is applied across the discharge points and the grounded casing or shield of such static bars, ions of each polarity are emitted. While positive and negative ion production may be precisely equal under certain circumstances, in most instances, ions of a particular polarity will predominate depending upon the geometry of the static bar and whether the ionizing points are capacitively coupled or directly connected to the A.C. high voltage.

In the direct connected static bar, there is usually a predominance of negative ions emitted, even though the discharge points are connected to an A.C. source having an equal positive and negative voltage amplitude. The excess negative ion production is the result of the greater mobility of such negative ions and also because of the inherent characteristics during corona formation wherein ionization occurs over a greater portion of the negative half cycle of voltage in relation to the ionization which occurs during the comparable positive half cycle. However, in the case of the capacitively coupled bar, there is usually a predominance of positive ions emitted. The greater production of positive ions in the latter instance results from the fact that a D.C. voltage is developed across the capacitance in the direction which biases the points slightly positive. That is, in the capacitively coupled system, the characteristic of a point to produce more negative ions during the negative half cycle of imposed voltage causes the capacitance to charge to a positive D.C. voltage which adds algebraically to the A.C. voltage. Hence, the voltage on the point with respect to the casing is greater during the positive half cycle than during the negative half cycle thereby causing excess positive ions to be emitted in the capacitively coupled bar. Therefore, if the material to be discharged lies upon or is adjacent to a grounded or other surface, the material may charge up to the polarity of the predominating positive charge being emitted by the capacitively coupled bar or to the predominating negative charge being emitted by the direct coupled static bar.

One of the methods used in the past to equalize the production of ions of each polarity was to incorporate a small D.C. power supply either between the casing and ground or between the A.C. generator and ground. See U.S. Pat. No. 2,879,395. The insertion of such a D.C. power supply functioned by placing a D.C. bias of the proper polarity on the casing or on the discharge points and was connected in such a way as to retard the output of ions of the usually predominant polarity and/or enhance the output of ions of the opposite polarity. Appropriate adjustment of the magnitude of the D.C. voltage provided the desired balance of positive and negative ion emission. While the D.C. power supply addition could be incorporated either between the bar casing and ground or between the A.C. generator feeding the points and ground in the case of the direct connected bar system, in the instance of the capacitively coupled system, the D.C. supply addition could only be inserted between the casing and ground. That is, if the D.C. power supply were incorporated between the A.C. supply and ground in the capacitively coupled static bar, the blocking effect of the capacitance would preclude biasing of the points. In any event, the D.C. generator addition has the disadvantage of requiring a separate power supply, thus making this arrangement expensive and bulky. Note also that where the D.C. generator is connected into the casing circuit, which is the only suitable location in the capacitively coupled static bar, the casing is raised above the level of ground so that the casing is "hot" and must be insulated to avoid shock to personnel. Moreover, the casing should be insulated to prevent contact of the casing to ground, a condition which would short circuit the D.C. generator.

Another, but less expensive, system for balancing the production of positive and negative ions is shown in U.S. Pat. No. 3,714,531 wherein a diode-resistor parallel circuit replaces the D.C. generator. However, this latter system, which also relies on changing the D.C. level of the casing with respect to ground or changing the D.C. level of the A.C. voltage applied to the discharge points, similarly demands insulation of the casing when interposed between the casing and ground because a voltage is being applied to the housing or casing. Moreover, the diode-resistor network cannot be embodied between the A.C. power supply and ground in the instance of the capacitively coupled arrangement because the capacitance between the points and the A.C. generator would again block the biasing effect.

It is therefore an object of this invention to provide a capacitively-coupled, point-electrode static eliminator in which an equal number of ions of each polarity are emitted.

Another object of this invention is to provide a static neutralizer having capacitively coupled discharge points which is readily adjusted so as to enable emission of an equal number of ions of each polarity.

Yet another object of this invention is to provide a capacitively coupled static eliminator having a balanced ion discharge.

Still another object of this invention is to provide a shockless type static eliminator in which a variable positive and negative ion emission may be effected within a range.

Yet still another object of this invention is to provide a balanced emission capacitively coupled static eliminator in which ion transmission is accomplished over relatively great distances.

Other objects of this invention are to provide an improved device of the character described which is easily and economically produced, sturdy in construction, and highly efficient in operation.

With the above and related objects in view, this invention consists of the details of construction and combination of parts as will be more fully understood from the following detailed description when read in conjunction with the accompanying drawing in which:

FIG. 1 is a sectional schematic view of a balanced emission static eliminator embodying this invention.

FIG. 2 is a perspective view, and partly broken away, of one embodiment of the balanced static eliminator.

FIG. 3 is a sectional view taken along lines 3—3 of FIG. 2.

FIG. 4 is a top plan view of another embodiment of the present balanced emission static eliminator.

FIG. 5 is a sectional view taken along lines 5—5 of FIG. 4.

Referring now in greater detail to the drawing in which similar reference characters refer to similar parts, there is shown a static eliminator in which pointed discharge electrodes, generally designated as A, are capacitively coupled to one side (usually the high voltage side) of an A.C. power supply B. The other side of the A.C. power source is normally at ground level and is directly connected to a conductive member C which is adjacently spaced from the discharge electrodes A whereby a corona effect is created in the air gap therebetween for emission of ions of both polarities to be impinged upon the surface of an article to be neutralized. In the present invention, a second set of pointed electrodes, generally designated as D, are adjacently spaced from the primary discharge electrodes A to counterbalance the inherent preponderance of positive ion emission characteristic of the capacitively coupled discharge points. In this manner, an equal number of ions of each polarity will be available for impingement upon the charged article which is intended to be neutralized, thereby neutralizing static charges and precluding the inducing of D.C. voltages on the surface of such articles. Diagramatically, the electrical schematic of the present inventive concept is illustrated by FIG. 1.

The high voltage A.C. power supply B is conventional and is adapted to furnish from about 2,500 to 15,000 volts A.C. at low amperage. The manner of capacitatively coupling the pointed electrodes A to the high voltage side of the A.C. power source B is generally well known, examples of which are shown in U.S. Pat. No. 3,120,626, 3,714,531 or 3,585,448 wherein the discharge points project from conductive rings (or a semi-conductive sleeve) which are concentrically disposed about an insulative cable whose central conductor is connected to the high voltage side of the A.C. high voltage generator. The conductive member C may be in the form of a rectangular casing or frame, as shown in U.S. Pat. No. 3,137,806, a flat apertured housing, as illustrated in U.S. Pat. No. 2,163,294, an apertured cylindrical housing, as demonstrated by U.S. Pat. No. 3,443,155, or merely a set of rods or bars which are adjacent to or straddle the points, as set forth in FIG. 6 of U.S. Pat. No. 3,120,626. Instead of a plurality of point discharge electrodes, a single discharge point electrode may be capacitively coupled to the A.C. power supply, such that the device takes the form of a grounded air nozzle, as illustrated in U.S. Pat. No. 3,179,849.

Referring now to FIGS. 2 and 3, there is shown an extended range shockless type static eliminator wherein a stream of air is blown by a fan 12 over the discharge electrodes A through circular apertures 14 in the housing C. This arrangement enables the positive and negative ions which are emitted to be carried by the air stream over a longer distance for impingement upon a more remote surface which is intended to be neutralized. The capacitively coupled discharge electrode assembly A includes an insulated cable W having a central wire conductor 16 jacketed within an encapsulating cover or skin 18. A plurality of conductive rings 20 and dielectric sleeves 22 are alternately disposed longitudinally along the cable W in slidable concentric configuration with the central wire conductor 16 and spaced thereabout by the insulative cover 18. A tubular jacket 24 of dielectric material is concentrically supported slidably about the rings 20 and spacer sleeves 22. The discharge electrodes A are in the form of pointed members 25 whose bases are pressed through openings in the jacket 24 into firm electrical contact with the conductive rings 20. End collars 26 of insulative material insure proper registration of the rings 20 with the openings in the jacket when the latter is longitudinally inserted over the rings 20 and spacers 22 annularly supported on the cable W. The ends of the tubular jacket 24 are mounted within support blocks 28 and 30 which are affixed to the interior of the housing C so that the points 25 of the discharge electrode assembly A co-axially project within the apertures 14 of housing C.

The wire conductor 16 of cable W is connected to the high voltage side of the A.C. generator B while the casing C is connected to the other side of the A.C. power supply B by way of ground.

In the embodiment illustrated in FIG. 2, a capacitively coupled discharge electrode assembly A is aligned with each row of apertures 14 in the housing C. The emission balancing electrode assembly D comprises a barbed conductive rod 32 oriented intermediate each pair of discharge electrode assemblies A in parallel disposition therebetween. Each rod 32 is slidably mounted within guide holes contained within the support blocks 28 and 30 and is retained in the appropriately adjusted position by set screws 34. Needle points 35 of conductive material outwardly project in pairs from opposite sides of each rod 32. The tips of the points 35 are located at a general level about one-third above the bases of the discharge points 25, each pair of pointed needles 35 being longitudinally spaced from each other by approximately the longitudinal spacing of the discharge points 25. The emission balancing electrodes are connected to the other side of the A.C. power supply by coupling the rods 32 directly to ground.

The pointed needles 35 are adjustably positioned with respect to the discharge points 25 by loosening the set screws 34 and slidably orienting the rods 32 until the number of ions of each polarity emitted from the static eliminator are equal. This can be determined by means of an electrostatic charge locator or charge level meter (not shown) which will register zero when the ion emission is properly balanced. It is to be noted that the number of balancing emission needles 35 need not be the same as the number of discharge points 25. It is merely essential that the overall emission from the static eliminator be neutral within the range of adjustment of the points 35. Thus, a lesser number of needles 35 vis-a-vis the discharge points 25 can accommodate a neutral condition by orienting the needles 35 closer to the points 25.

In FIGS. 4 and 5, there is shown a modification in which the housing C is not employed, but rather a pair of conductive rods C1 straddle the discharge points 25. A single set of needle points 35 project from one of the rods 32A of the conductive rod member C1, the rod 32A being slidably and adjustably positioned both longitudinally and rotatably within the support blocks 28. The rod 32A, as well as rod 32B of the conductive member C1, is directly connected to the ground side of the high voltage power supply B while the points 25 are capacitively coupled to the high voltage side of the A.C. power supply B in the usual manner. After the needles 35 are appropriately adjusted to yield a balanced emission from the discharge points 25 by rotatably and longitudinally orienting the rod 32A, the set screw 34 is locked in position.

As is apparent from the foregoing description, the pointed electrodes D are directly connected to the opposite side of the A.C. generator B whose first side is capacitively coupled to the discharge electrodes A, the points 35 usually being connected by way of a conductive rod 32 or 32A and grounded. The pointed electrodes D emit ions by virtue of their points 35 being adjacently spaced from the primary discharge points 25 so that a voltage gradient is established therebetween. Because the capacitively coupled discharge electrode points 25 are operating at a slightly positive D.C. level, as previously discussed, and because the second set of needle points 35 are directly connected to ground, a preponderance of negative ions is emitted from the points 35 of the emission balancing electrode D, thereby tending to reduce the normally predominant positive ion output of the capacitively coupled discharge points 25. By adjustment of the position of the points 35 of the emission balancing electrode D with respect to the points 25 of the discharge electrode A, the preponderance of positive ions can be cancelled so that equal numbers of positive and negative ions are produced. It is also to be noted that the position of the points 35 can be so adjusted in closer disposition to the points 25 as to cause actually a production of excess negative ions. When adjusted so that the combined output of the two electrode systems A and D contains equal numbers of positive and negative ions, an equal number of ions of each polarity will then be available for impingement upon the charged article which is intended to be neutralized, thereby neutralizing static charges and precluding the inducing of D.C. voltages on the surface of such articles.

Where the capacitively coupled discharge electrode A is not supported within a housing C nor sufficiently close to an adjacent grounded conductive member C1, such as a conductive rod 32A or the like, or when the conductive rod member C1 is insulated by a non-conductive covering or when an adjacent grounded member is not present at all (neither of the last mentioned cases being shown in the drawing), it is necessary to mount a grounded conductive needle 35 adjacent each discharge point 25. As in the previously discussed embodiments shown in the drawing, the needles 35 must be adjustably spaced from the discharge points 25 in order to produce an equal number of positive and negative ions in the emitted corona discharge.

Although this invention has been described in considerable detail, such description is intended as being illustrative rather than limiting, since the invention may be variously embodied without departing from the spirit thereof, and the scope of the invention is to be determined as claimed.

What is claimed is:

1. In a static neutralizer having at least one pointed discharge electrode and including means for capacitively coupling each such pointed discharge electrode to the high voltage side of an A.C. high voltage source, the improvement comprising: a conductive needle adjacently spaced from and in interacting disposition with at least one such pointed discharge electrode, and means constituting a conductive path connecting each conductive needle to the other side of said A.C. high voltage source so as to enable emission of an equal number of ions of each polarity from the static neutralizer per se.

2. The static neutralizer of claim 1 wherein the other side of the A.C. high voltage source and each of said conductive needles are grounded.

3. The static neutralizer of claim 1 wherein adjustable means support each conductive needle with respect to the next adjacent pointed discharge electrode to permit varying the spacing therebetween.

4. The static neutralizer of claim 1 including apertured casing means adjacently spaced with respect to said pointed discharge electrodes and said discharge electrodes projecting therewithin.

5. The static neutralizer of claim 4 wherein said casing means is of conductive material and is coupled by way of a conductive path to the other side of the A.C. high voltage source.

6. The static neutralizer of claim 1 including means to blow a stream of air over said pointed discharge electrodes.

7. In a static neutralizer having a plurality of pointed discharge electrodes and including means for capacitively coupling each of said pointed discharge electrodes to the high voltage side of an A.C. high voltage source whose other side is connected by way of a conductive path to a conductive member in adjacently spaced disposition with respect to said pointed discharge electrodes, the improvement comprising: a plurality of conductive needles adjacently spaced from and in interacting disposition with respect to at least some of said pointed discharge electrodes, and means constituting a conductive path connecting said conductive needles to the other side of said A.C. high voltage source so that an equal number of ions of each polarity can be emitted from the static neutralizer per se for impingement upon an article to be neutralized.

8. The static neutralizer of claim 7 including adjustable means for varying the spacing of said pointed conductive needles with respect to said pointed discharge electrodes.

9. The static neutralizer of claim 7 wherein said conductive member comprises an apertured conductive casing within which said pointed discharge electrodes project.

10. The static neutralizer of claim 9 including means for blowing a stream of air through said casing and axially about said pointed discharge electrodes.

* * * * *